US008390195B2

(12) United States Patent
Huettinger et al.

(10) Patent No.: US 8,390,195 B2
(45) Date of Patent: Mar. 5, 2013

(54) HIGH PRESSURE DISCHARGE LAMP

(75) Inventors: Roland Huettinger, Kaufering (DE); Stefan Juengst, Zorneding (DE); Stefan Kotter, Augsburg (DE); Steffen Walter, Oberpframmern (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 13/201,225

(22) PCT Filed: Feb. 2, 2010

(86) PCT No.: PCT/EP2010/051254

§ 371 (c)(1),
(2), (4) Date: Aug. 12, 2011

(87) PCT Pub. No.: WO2010/091980

PCT Pub. Date: Aug. 19, 2010

(65) Prior Publication Data

US 2011/0291557 A1 Dec. 1, 2011

(30) Foreign Application Priority Data

Feb. 12, 2009 (DE) ..... 10 2009 008 636

(51) Int. Cl.
*H01J 17/16* (2006.01)
*H01J 61/30* (2006.01)

(52) U.S. Cl. ..... 313/625; 445/26; 313/624

(58) Field of Classification Search ..... 313/623–625, 313/635, 636, 634; 445/26, 43
See application file for complete search history.

(56) References Cited

U.S. PATENT DOCUMENTS

| | | | | |
|---|---|---|---|---|
| 5,742,123 | A | 4/1998 | Nagayama | |
| 6,020,685 | A | 2/2000 | Wei et al. | |
| 6,375,533 | B1 * | 4/2002 | Torikai et al. | 445/26 |
| 6,863,586 | B2 | 3/2005 | Okuyama | |
| 7,977,885 | B2 * | 7/2011 | Bewlay et al. | 313/623 |
| 8,115,390 | B2 * | 2/2012 | Huettinger et al. | 313/624 |
| 2003/0080684 | A1 * | 5/2003 | Okuyama | 313/625 |
| 2006/0279218 | A1 | 12/2006 | Uemura et al. | |
| 2007/0120491 | A1 | 5/2007 | Bewlay et al. | |
| 2008/0211410 | A1 * | 9/2008 | Bewlay et al. | 313/625 |

FOREIGN PATENT DOCUMENTS

EP 0587238 A1 3/1994

* cited by examiner

*Primary Examiner* — Mariceli Santiago
*Assistant Examiner* — Glenn Zimmerman

(57) ABSTRACT

A high pressure discharge lamp may include a ceramic discharge vessel and a longitudinal axis, wherein at least one electrode is led out of the discharge vessel by means of a metal-containing feed-through, wherein the feed-through is connected to one end of the discharge vessel by way of a ceramic-containing adjustment part, wherein the adjustment part is tubular and consists of individual layers with different compositions, at least two materials A and B forming a plurality of layers of the adjustment part, these materials being chosen such that their coefficient of thermal expansion is between that of the feed-through and that of the end of the discharge vessel or at most is just outside, the layer thickness of each layer being so low that no shearing forces can occur, and the layer thickness of each layer of the same material being different.

11 Claims, 4 Drawing Sheets

HIGH PRESSURE DISCHARGE LAMP

RELATED APPLICATIONS

The present application is a national stage entry according to 35 U.S.C. §371 of PCT application No. PCT/EP2010/051254 filed on Feb. 2, 2010, which claims priority from German application No.: 10 2009 008 636.6 filed on Feb. 12, 2009.

TECHNICAL FIELD

Various embodiments provide a high pressure discharge lamp.

BACKGROUND

A high pressure discharge lamp is known from U.S. Pat. No. 5,742,123 and U.S. Pat. No. 6,020,685 and U.S. Pat. No. 6,863,586 in which a ceramic discharge vessel uses a radially layered cermet part at its ends for sealing.

Previously a radial gradient structure has been used in which the gradient changes monotonously from the first innermost layer to the last outermost layer. A gradual graduation of the coefficient of thermal expansion is achieved in the cermet part thereby, so the jump in the coefficients of thermal expansion between the two materials ceramic of the discharge vessel and metal of the feed-through is attenuated as well as possible. Such gradually graduated layers can have different thicknesses. They can be produced using different methods, in particular by immersing, spraying and molding. The individual layers can be circular-cylindrical or the cermet part can also be continuously produced by helical winding.

SUMMARY

Various embodiments provide a high pressure discharge lamp having a ceramic discharge vessel whose sealing is based on the concept of a gradient cermet, and in the process assures an adequate life for use in general lighting.

Due to the different coefficients of thermal expansion of the individual components, the sealing technology in Hg high pressure discharge lamps having a ceramic discharge vessel, in particular with aggressive metal halide filling, is still a problem that has yet to be satisfactorily solved.

In the process cracks form primarily in the region of the electrical connections since the different coefficients of thermal expansion are too far apart during heating and then cooling again during the switching on and off processes. The $Al_2O_3$ that is mostly used for the discharge vessel has a typical coefficient of thermal expansion of $8.3\times10^{-6}$ $K^{-1}$, conventional cermet parts have a coefficient of thermal expansion of 6 to $7\times10^{-6}$ $K^{-1}$. A molybdenum pin has a coefficient of thermal expansion of approximately $5\times10^{-6}$ $K^{-1}$.

The sealing technology of ceramic high pressure discharge vessels has a characteristic problem, namely where the electrode feed-through system enters through the ceramic capillary and into the discharge space as an electrode shaft. This region includes an annular gap which extends along the electrode shaft deep into the capillary and through to the sealing solder. This gap is a dead volume behind the actual discharge space in which parts of the burner filling substances can condense. This has an adverse effect on the electrical and photometric properties and the life of the discharge lamp. There have been only rudimentary attempts at eliminating this gap completely. A first approach consists in creating sealing plugs in which a cermet-containing adjustment part is radially constructed on the feed-through system without generating a capillary or annular gap of this kind in the process. Such plugs, which are constructed from a cermet adjustment part with radially oriented material gradient between current feed-through and the ceramic of the discharge vessel, have inter alia the following disadvantageous features, however:

a) the graduation of the coefficient of thermal expansion (CTE) of the layers constructed on top of one another is usually very coarse;

b) the layers with different CTE within the gradient structure are thick because the individual layers cannot be produced thin enough and in adequate numbers c) critical local material stresses at material interfaces of excessively thick layers with excessive graduation of the CTE can occur d) the joining of the cermet part to the electrode system and the ceramic presents difficulties e) the desired radial material gradient (MG) cannot be precisely and reproducibly adjusted to an optimal gradient because this is not easy to achieve in terms of production engineering.

Sealing plugs (cermets) with radially oriented material gradients are described in various patents (see above). All known radial gradient structures consist of an arrangement of n adjacent layers with a coefficient of thermal expansion (CTE) that gradually changes monotonously from layer to layer. The change in gradient takes place such that the CTE increases from layer to layer either always by a defined amount ($\alpha_1<\alpha_2<\alpha_3\alpha<\ldots\alpha_n$) or is reduced ($\alpha_1>\alpha_2>\alpha_3>\ldots\alpha_n$), depending on the viewing direction. This change can be linear or non-linear, the layers may also have different thicknesses. Such gradually graduated layers can be applied to each other using different methods (for example by immersing, spraying, molding, etc.).

Manufacturability, precision, reproducibility and functionality of this composite structure are difficult to control. Production expenditure and level of difficulty increase as the graduations become smaller.

The novel structure of a cermet-containing adjustment part fundamentally differs from the previous one. According to the invention the material gradient in the case of a cermet is not adjusted from layer to layer by a graduation of the coefficient of thermal expansion but by the change in thickness of alternately occurring layers of at least two components A and B which are stipulated in terms of their composition, with their corresponding coefficients of thermal expansion CTE of $\alpha_1$ and $\alpha_2$ in the sequence A/B/A/B/A/B . . . , etc. The material gradient is therefore merely a function of the change in thickness of the individual layers A/B which can each be defined as a function of the radius. These functions can be linearly or non-linearly described by any desired mathematical formulation depending on which radial gradient (for example calculated from models) is desired.

To ensure the functionality of the structure layered in this way it is crucial that the alternating layers are dimensioned to be so thin that the material stresses at the interfaces of the microscopically thin layers remain below the critical shear stress. The layers consequently cannot shear off each other and delaminate, the mechanical strength between the layers and the structural integrity of the composite material persists over a long period. The radial gradient that can be individually adjusted over the layer thicknesses is ultimately used for adjustment of the cermet to the coefficient of expansion and geometry factors of the components to be joined together. These components are in particular a centrally located electrode feed-through made of corrosion-resistant metal on the one hand, here to be taken to mean component A, and on the other hand the cylindrical tube end of the discharge vessel that encompasses the feed-through further out and which is made from ceramic. The latter is to be taken to mean component B.

Either the same material or a material that is similar in terms of coefficient of thermal expansion as/to component A, specifically: the feed-through, is used as material A for the cermet. This material A adjoins component A, here: the feed-through, with a layer of maximum thickness DA1. Conversely, material B is based on component B. Specifically either the same material as the ceramic of the discharge vessel is used as material B or a material that is similar in terms of coefficient of thermal expansion to the ceramic of the discharge vessel or the sealing part (plug, capillary, etc.) of the discharge vessel or the like, in general called the material of the end of the discharge vessel here. This material B adjoins component B, i.e. in particular the end of the discharge vessel with a layer of maximum thickness DB1.

Alternatively a further layer of minimum thickness of the other material B may be introduced between component A and the first layer of material A with maximum thickness. The same is possible at the other end as well: a further layer of maximum thickness of the other material A can be located between component B and the first layer of material B with maximum thickness.

From a practical point of view the maximum thickness layer MaxD should not exceed 200 μm thickness. This applies equally to MaxDA and MaxDB. From a practical point of view the thinnest layer MinD should not exceed 1 μm thickness and this also applies equally to MinDA and MinDB. The maximum layer thickness is preferably 150 μm at most.

Values of the layers which are between 5 and 100 μm are preferred in particular. A symmetrical construction is also preferred in the sense that MinDB directly follows MaxDA and the reverse applies at the other end such that MinDA directly follows MaxDB, it being possible for the layer thicknesses of MaxDA and MaxDB to be equal. The same applies to MinDA and Min DB.

The gradient cermet is preferably constructed from an even number of layers, at least viewed in section, the layer thickness being mirror symmetrical with respect to the center. This dimensioning may be achieved in both axial and radial gradient cermets.

To achieve the desired cermet diameter and radial gradient an appropriately high number of thin layers is constructed and sintered to form the desired composite matrix. These alternating, relatively thin layers that change in thickness or layer thickness ratios can be seen along the cermet radius on cuts of completely sintered samples.

A specific layer construction is then selected such that the following applies in particular for material A: the thicknesses MinDA and MaxDA are freely selected, the thickness of the layers DA located therebetween increases linearly between the extreme values. The same applies to material B but in the opposite direction.

Pairs of alternating layers A and B, i.e. by way of example MaxDA and MinDB, should each be dimensioned such that the following applies as far as possible to any layer pair n:

$$DA_n+DB_n=\text{const.}$$

This sum value does not have to be exactly constant, however, it should preferably not vary by more than 40%, in particular at most 20%, based on the mean of all pairs.

The application of the above-described principle also provides advantages which affect the production of the cermet as such:

Since at least one of the two layer components, A or B, can be applied with very small initial layer thicknesses of in particular less than 5 μm, a large margin for layer thickness increases opens up in order to be able to construct the material gradients over a large number of increasingly thick layers without exceeding the maximum permissible stress-critical layer thicknesses in the process.

Since the layers can generally be applied thinly an appropriately defined radial gradient can be divided into very small stages.

In the case of the simple dual system, including the layer components A and B, only two different slips have to be produced, and this simplifies slip production considerably.

The application of just two different slips to form a large number of alternating layers with variable thicknesses is significantly simpler than the production and application of a large number of different slips with their respective compositions that have to be mixed and coefficients of expansion resulting therefrom.

The layer components A/B are limited not just to the material system $Mo/Al_2O_3$ listed as an exemplary embodiment but may also be expanded to any other material systems which are relevant to the production of cermets for ceramic discharge vessels. The system $W/Al_2O_3$ is of particular interest as an alternative. However, by way of example AlN, aluminum oxynitride, $Dy_20_3$, etc. are also suitable as ceramic, and this causes correspondingly adapted components A and B.

Components A/B can also be mixtures, in particular they can be mixed in themselves, so component A by way of example contains a certain content of component B and possibly vice versa. Component A with the B content in turn represents the recurring CTE $\alpha_1$, component B with the A content the CTE $\alpha_2$.

The layer components A/B can generally consist of all possible material compositions.

The binary layer system A/B can in particular also be expanded to form a multi-layer system by adding further components, in particular at least one further component C, so the layer sequence is: A,B,C, . . . /A,B,C . . . /A,B,C, . . . , etc.

Each component also includes its individual material composition and its respective coefficient of thermal expansion here as well. The gradient is optionally again solely defined in such an expanded material system by the change in layer thickness of the individually recurring layer components A,B, C, . . . . Layer C can in particular be a material which has an effect on grain growth, layer adhesion, etc., and in particular C can be constructed here as MgO. With such a component C it is not imperative for the layer thickness to vary. The thickness of the individual layers of component C can be the same or similar. In this case a system is in particular preferred in which the thickness of C, here called DC, is at most five times the thickness of the minimum layer of component(s) A and/or B. A practical lower limit of such a layer thickness lies at a few nanometers, if this layer is sprayed onto one of the components A or B.

Of course it is also not impossible to alternate the components, i.e. for example a system is used in which component A consists of Al203. Component B is firstly Mo but W is used in some of the layers. Systems in which Mo alone and/or partial admixture of Ir or Re, in particular as a doping, is used are also of interest.

Out of the variation options from the embodiments listed above arises the possibility of adjusting the individual layer components in such a way that an effect can be had for example on sintering shrinkage, grain growth, sintering density, mechanical strength and other important properties of the cermet plug.

The cermet adjustment part that can be produced according to the above principle has further advantages which affect the adjustment to the electrode feed-through system and the discharge vessel. It may be axially or radially constructed.

The cermet can be radially constructed on a centrally located current feed-through system such as a metal tube or a metal rod or pin made of conductive cermet or on a corresponding partially sintered structure or on a corresponding completely sintered structure or on a corresponding ("green") structure that has not yet been sintered.

The cermet can, moreover, be constructed and sintered on the feed-through system in such a way that no gap is produced along the contact face, so the electrode system emerges from the material of the cermet plug entirely without a gap for the first time, even if a radial gradient cermet is chosen.

In particular the cermet part can be freely formed around the point of the electrode system exit, so the feed-through emerges for example from a plane end face or inwardly or outwardly from a bulge or from an inwardly or outwardly formed funnel.

This freeforming applies to the first, viewed axially, inner, side of the electrode system feed-through and to the second, viewed axially, outer, side thereof.

Freeforming of the cermet provides the possibility of optimally shaping the plug geometry between electrode shaft and burner wall. Shaping can take place on the green cermet part or on the completely sintered cermet part, by way of example by scraping or grinding.

The cermet part can be provided in such a way that in particular it can be sintered into the discharge vessel or in particular can be soldered into the discharge vessel with an appropriately high temperature solder, as the latter is generally known.

The outstanding advantage of this novel concept consists in the possibility of being able to create an absolutely gap-free electrode system feed-through. This brings about a significant improvement in the electrical and photometric properties, which previously constituted a problem intrinsic to the system, as well as an increase in the life of ceramic high pressure discharge vessels.

In a further exemplary embodiment the sealing system is constructed such that a ceramic discharge vessel with capillary ends is used. A tubular cermet part (cermet tube) with an axial gradient adjoins this which has approximately the same internal diameter and external diameter as the capillary. The cermet tube is joined to the end of the capillary by way of a glass solder which melts at approximately 1,500 to 1,700° C. and allows a permanent interface connection. Alternatively, joining occurs by sintering by means of a fine-grain sinter-active $Al_2O_3$ powder. A cap made of molybdenum and with a central hole sits on the cermet tube. A pin made of molybdenum is used at least at the outer end as a feed-through part. It typically has a diameter in the range of 0.6 to 1.2 mm. For the seal the pin made of molybdenum is welded to the cap. The cap is joined to the cermet tube by soldering by means of a metal-based solder. A platinum solder is preferably used. Alternatively a sinter-active connection may also be chosen.

The problem of the rapidly changing coefficients of thermal expansion of capillary, cermet tube and cap is solved by using a cermet tube which uses a large number of layers. Instead of approximately 10 layers as previously, for the first time at least 50 thin layers are used, and preferably at least 100 layers, typically up to 200 layers. This is possible due to multi-layer technology for the production of thin foils of typically 20 to 100 μm tape thickness.

The cermet tube functioning as an adjustment part consists of Mo—$Al_2O_3$ layers of different composition.

A first layer of the cermet tube is placed onto the end face of the capillary end, the layer being rich in $Al_2O_3$ and poor in Mo. A volume ratio of 90/10 to 98/2 between $Al_2O_3$ is typical. However, pure $Al_2O_3$ may also be used in the first layer. The second layer is rich in Mo, with typically a 95% by volume Mo content.

The cermet tube has a graduated structure with alternating thickness of the individual layers, the Mo content alternating from layer to layer. Finally the cap is soldered onto the Mo-rich final layer. In one embodiment separate first and last layers are provided between which the adjustment part is fitted, these extra layers in particular being much thicker than the intermediate layers of the adjustment part in order to improve the mechanical durability.

The graduated cermet tube is produced by way of example using multi-layer technology. Thin foils with two different $Mo/Al_2O_3$ ratios are produced for this. Component A can by way of example be $Al_2O_3$ with an Mo content of 95% by volume, while component B can be $Al_2O_3$ with an Mo content of 5% by volume.

Only the thickness of the individual foils is very different. The foils are then stacked and laminated in accordance with the above instructions. Hollow cylindrical tubes are then punched out of the laminated foils joined to form plates and consequently have a laminated structure along their longitudinal axis. After sintering the hollow cylinder the graduated tubes formed therefrom are applied to the ends of the capillaries by means of high-temperature solder or active sinter powder and at their other end, which includes a foil with a high Mo content, are soldered to the cap. A construction of this kind also ensures secure sealing of the two end faces of the cermet. Previously such a fine graduation was not deemed necessary, a suitable production method could not be disclosed for it and a secure way of joining the cermet tube to the other parts could not be found either.

The individual foils, apart from optionally the two covering foils in the first and last positions, preferably have a symmetrically alternating thickness.

The Mo content in the first and last foils should be about 5 or 95% by volume respectively because then the thermal coefficient of expansion of these mixtures is very close to the adjoining material Mo or $Al_2O_3$.

Producing the cermet tube using multi-layer technology has the advantage that the composition of the slip for producing the individual foils can occur in any desired $Mo/Al_2O_3$ ratio.

A thickness of the individual foils (tapes) of only typically 20 to 100 μm is also possible thereby. With the given graduation and total number of individual foils a greater thickness of the individual foils would lead to an excessive thickness of the graduated tube. The thickness of the individual tubes ultimately determines the degree of graduation of the thermal coefficient of expansion in the cermet tube.

A particular advantage of the overall concept is that the individual components for the sealing technique can be produced separately. The overall seal has a modular construction.

The individual foils of the cermet tube are joined together in a gas-tight manner by a sintering process, an intimate connection being produced between the individual layers of different composition. Cracks as a result of thermo-mechanical stresses are minimized and largely avoided thereby. It has proven to be particularly successful if a two-stage sintering process is used. Firstly the foil system is pre-sintered, with a certain shrinkage of the cermet tube occurring unhindered. Only then is a feed-through inserted in the opening of the cermet tube and the pre-sintered foil system finally sintered onto the, in particular metallic, feed-through. Particularly high tightness is achieved with this method.

In a special embodiment the end face of the capillary is beveled. This is used for improved centering and for delaying delamination between the first cermet layer and the PCA of the discharge vessel during its life. Beveled edges are usually more stress-free in ceramic joining technology than straight faces.

Correspondingly, the end face of the cermet tube facing the capillary is also beveled. The first foil originally has a particularly thick construction for this purpose, typically up to 300 μm, and the bevel is pressed into this first zone of the cermet tube.

The ceramic discharge vessel is preferably made of $Al_2O_3$, for example PCA. The conventional dopings, such as MgO, can be used. PCA can also be an integral component of the tube even as an end layer.

High-temperature glass solders, such as a mixture of $Al_2O_3$ and $Dy_20_3$ or another rare earth oxide, can be used as the glass solder, see by way of example EP-A 587 238 for a more detailed description. These mixtures are more thermally resilient than the conventional solders but for a good connection require more time than is usually available during the melting process.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
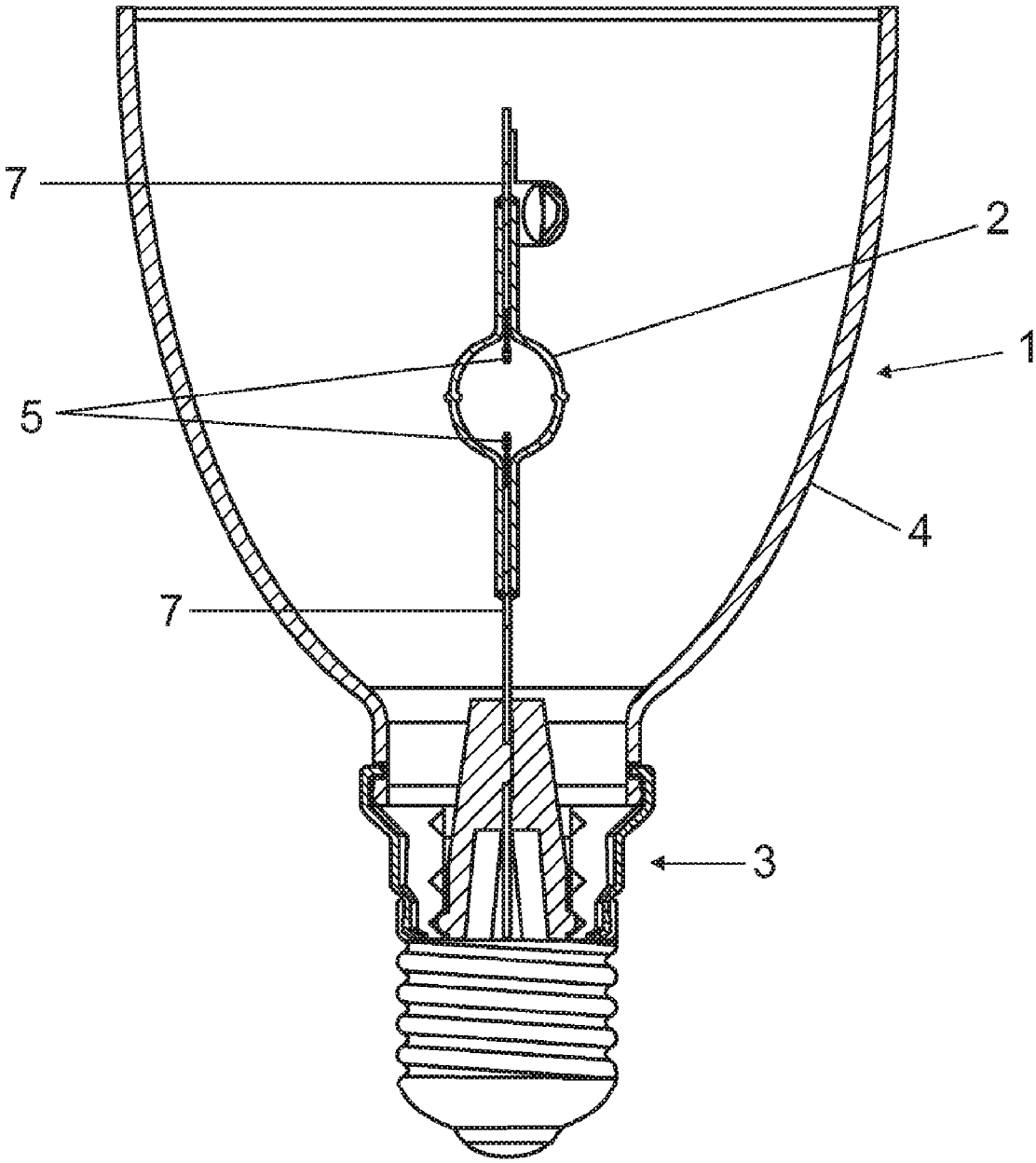
FIG. 1 shows a reflector lamp having a ceramic discharge vessel.

FIG. 1 schematically shows a reflector lamp 1. It has a ceramic discharge vessel 2, which is secured in a base 3, and two electrodes 5 in the discharge volume. Feed-throughs 7 project from the discharge vessel. Secured to the base is a reflector 4 in which the discharge vessel is axially arranged. The discharge volume contains a filling, typically with metal halides and mercury.

Figure 2:
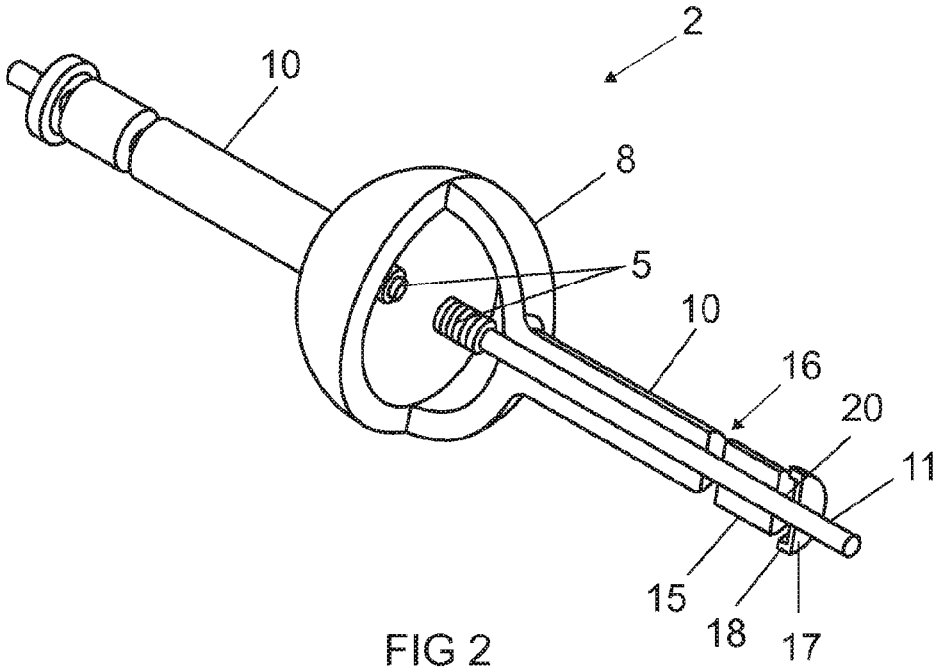
FIG. 2 shows a ceramic discharge vessel in an exploded view, partially cut.

FIG. 2 shows the discharge vessel 2 which is substantially produced from $Al_2O_3$, and which has a round-bodied central part 8 in which electrodes and a filling with metal halides is accommodated. Capillaries 10 are integrally attached to the central part. Feed-throughs 11, by way of example Mo pins or multi-part feed-throughs as are known per se, are guided therein and to which the shaft of the electrode is welded respectively. However, it is only essential that the trailing end of the feed-through is an Mo pin. It has a diameter of typically 1 mm. A cermet tube 15 made of typically 50 layers of foils adjoin the capillaries 10 as an adjustment part. The foils typically have different thicknesses in a range from 10 to 100 μm, with the possible exception of the first and last foils, which can each be up to 200 to 300 μm thick. A high-temperature solder 16 is introduced between capillary and cermet tube. A cap 17 made of molybdenum and with a bent edge 18 is attached to the outer end of the cermet tube, a platinum solder 19 for sealing being introduced between cermet tube and cap. The cap 17 is an Mo sheet with a thickness of typically 200 to 500 μm.

The cap 17 is welded to the feed-through 11 which is lead through a central hole 20 in the cap. The cap is preferably curved inwards for improved weldability (21).

A gap of 50 to 100 μm width typically remains between Mo feed-through 11 and capillary 10. The same applies to the gap between cermet tube 15 and Mo feed-through 11.

Typical fillings for lamps of this kind are described by way of example in EP-A 587 238.

Figure 3:
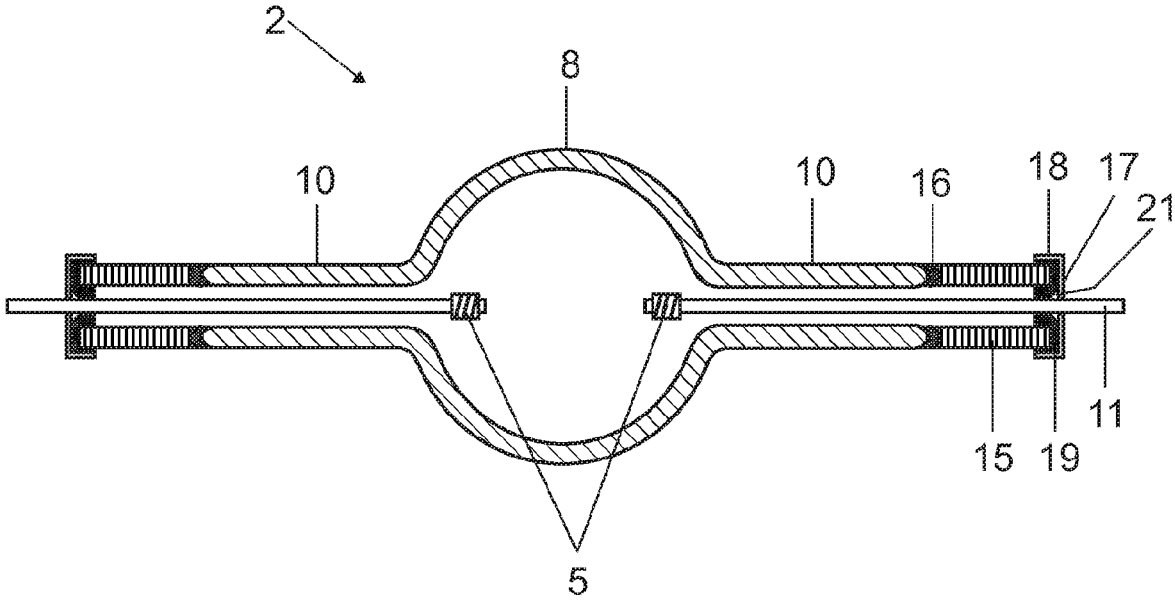
FIG. 3 shows a cross-section through the discharge vessel of FIG. 2.

This construction with axial adjustment part is shown highly schematized in detail in FIG. 3. The Mo content in the first layer facing the capillary is 0 to 15% by volume and in the last layer is 85 to 100% by volume, the remainder is optionally $Al_2O_3$. By way of example 30 to 100 layers of approximately 10 to 100 μm thickness each are located therebetween, with the layer thicknesses alternating. The Mo content is constant in the layers of components A and B respectively. As the key to reliable gap-free sealing it has proven expedient for the layer thicknesses, when viewed absolutely, to be significantly below a limit critical for the shearing forces.

The feed-through is preferably a pin, in particular made of Mo. Its diameter is preferably 0.4 to 0.9 mm. It can, however, also be a tube by way of example through which the discharge volume can be directly filled, as is known per se.

The individual layers of the foils are preferably cast from pastes with a thickness of up to 150 μm. The paste consists of ceramic or metallic powder or mixtures thereof to which is added a polymer, softener and solvents, as is known per se. Green foils are thus produced made of polymer-bonded Mo-based and $Al_2O_3$-based powder mass.

Figure 4:
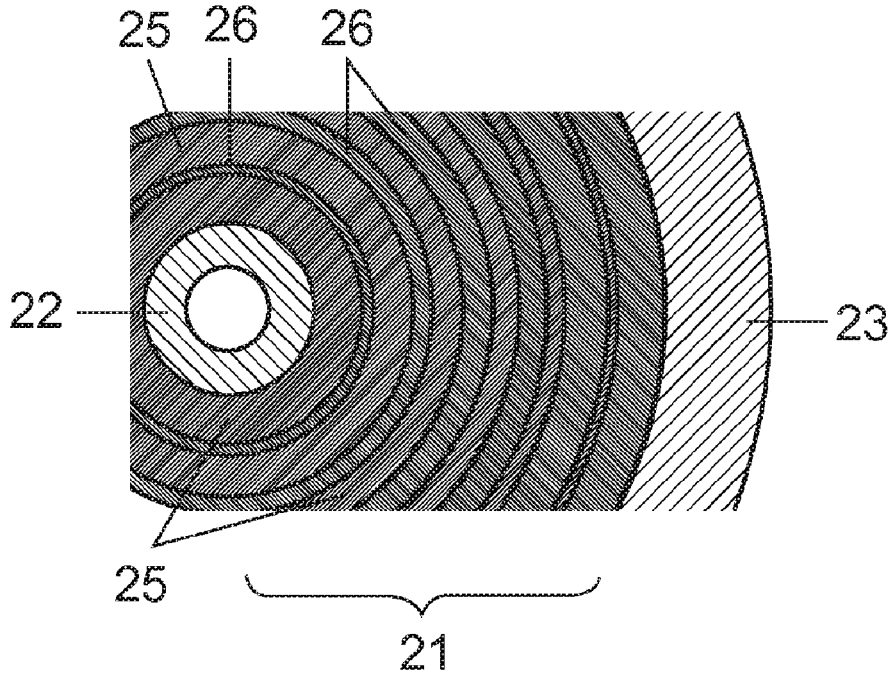
FIG. 4 shows a cross-section through a further exemplary embodiment of a discharge vessel.
Figure 5:
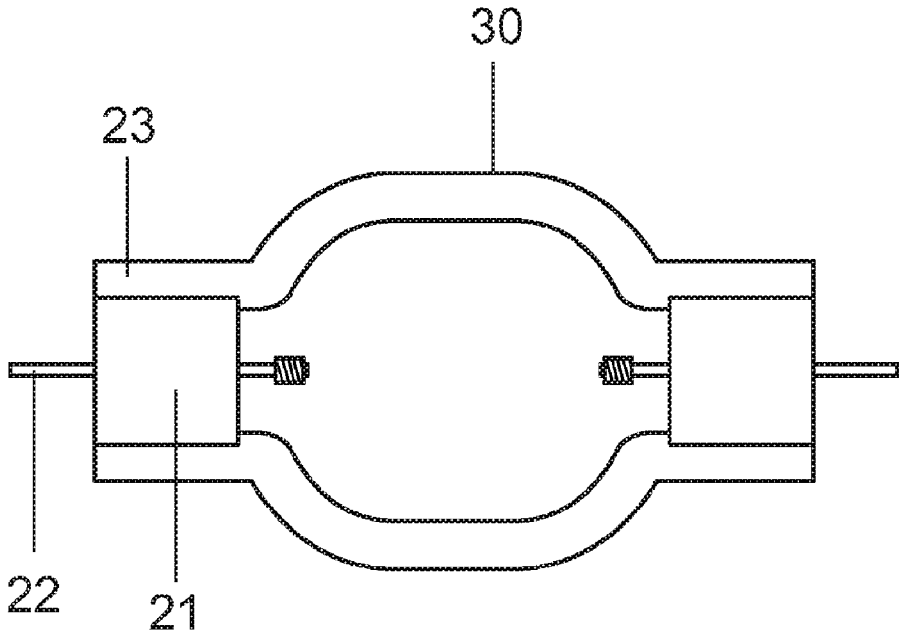
FIG. 5 shows a ceramic discharge vessel in a further exemplary embodiment.

FIGS. 4 and 5 shows a radially structured adjustment part. It is a cylindrical tube 21 which attaches directly to the feed-through 22 made of Mo. At the outside the tube 21 is limited by the capillary 23. The tube 21 is directly sintered in between feed-through 22 and capillary 23. The tube 21 consists of typically 30 layers. Layers 24 of component A alternate with layers 26 of component B. Component A has a coefficient of thermal expansion which is just below that of $Al_2O_3$ and component B has a coefficient of thermal expansion which is just above that of Mo. Both therefore lie between the coefficients of thermal expansion of the feed-through 21 on the one hand and the capillary 23 on the other.

However, it is not impossible to choose a system in which component A has a coefficient of thermal expansion which is just above that of $Al_2O_3$ and component B a coefficient of thermal expansion which is just below that of Mo.

The novel principle of the layer construction shall be described by way of example here:

The layer thickness of the first, innermost layer 25 is relatively large (90 μm), the layer thickness of the next first layer 26 is relatively small (10 μm). The thickness of the next layer 25 is slightly smaller than that of the first layer 25, namely approximately 80 μm. The layer thickness of the next second layer 26 is slightly thicker than that of the first layer 26, namely approximately 20 μm. The layer thickness of component A continuously decreases in this way to the outside while the layer thickness of component B continuously increases to the outside. In the case of the last two outer layers the situation is that the last outer layer 25 is approximately 10 μm thick, while the last outer layer 26 is approximately 90 μm thick.

FIG. 5 shows a discharge vessel 30 in cross-section. The radial adjustment part is a straight truncated cylindrical tube here.

Figure 6:
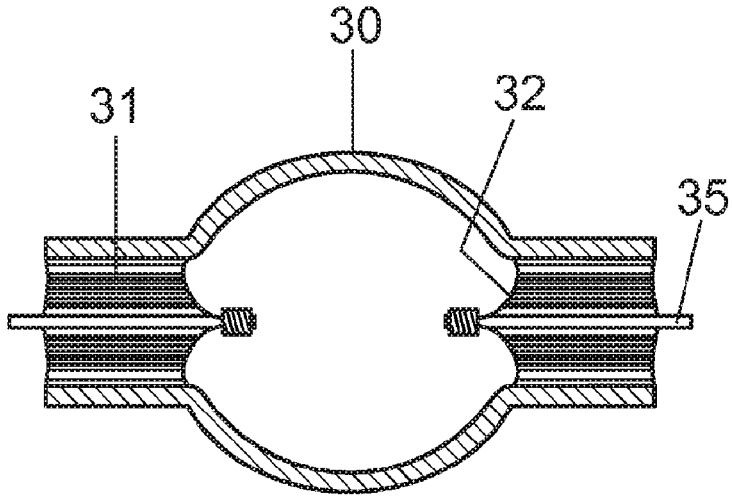
FIG. 6 shows a cross-section through a further exemplary embodiment of a discharge vessel.

FIG. 6 shows as a further exemplary embodiment a basically similar configuration of a discharge vessel 30. However, the radial adjustment part 31 is a cylindrical tube whose inner end face 32 turned toward the discharge is concave. The pin 35 of the feed-through is also concave, at least in a section, so it fits with the curvature of the adjustment part. The end face may thus be optimally adjusted to the geometry of the discharge vessel, and this is particularly important for the formation or suppression of undesirable stationary waves in resonance mode.

In a further exemplary embodiment the cermet part is constructed with its layers as archimedian spirals, the layer thickness being based on a cross-section. To achieve a circular cylindrical form here, which is adapted to the plug, the cermet part is appropriately pressed in at the end.

Figure 7:
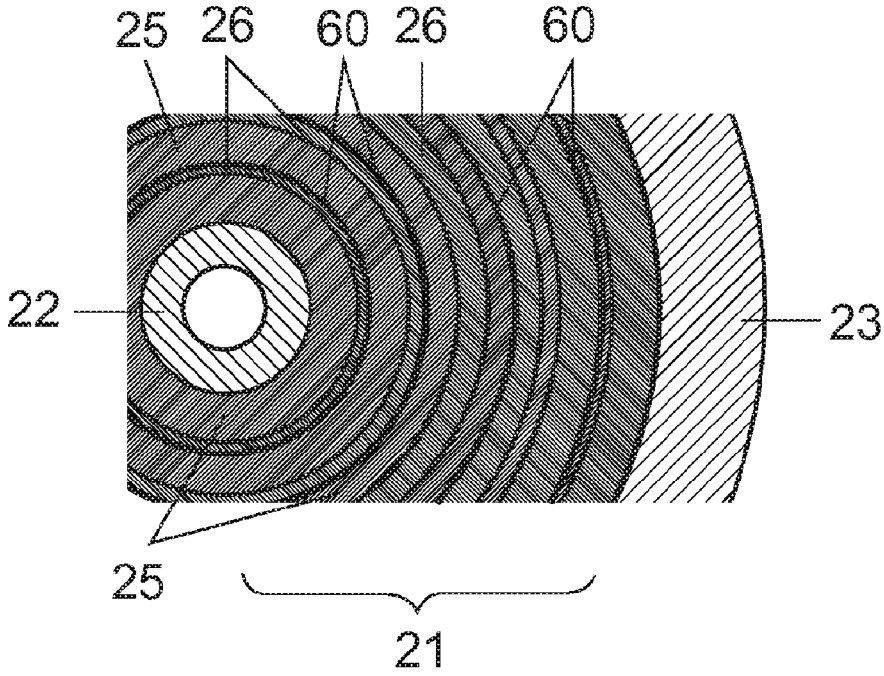
FIG. 7 shows a cross-section through the plug of a further exemplary embodiment of a discharge vessel.

In a further exemplary embodiment according to FIG. 7 the cross-section through a capillary is shown. The adjustment part consists here of components A, B and C, with A and B corresponding to the components of FIG. 4. A respective layer 60 of MgO is added as component C, with the layer thickness being constant in each case and being approximately 5 μm. Obviously it is irrelevant whether the formal layer sequence is ABC or, by way of example, ACB.

The coefficients of thermal expansion of layers A and B can also lie outside of the range of the coefficients of thermal expansion of components A and B but should preferably differ therefrom by 10% at most.

Apart from metals such as Mo or W, a metal-containing cermet, as is known per se, is also particularly suitable as a feed-through. The feed-through therefore preferably consists of metallic Mo or W or predominantly contains these, whether as a cermet or as a coated or doped material, with the corresponding material of the adjustment layer comprising Mo powder or W powder in a content of at least 85% by volume.

Various embodiments provide the following features in the form of a list: Various embodiments provide a high pressure discharge lamp having a ceramic discharge vessel and a longitudinal axis, wherein at least one electrode is led out of the discharge vessel by means of a metal-containing feed-through, wherein the feed-through is connected to one end of the discharge vessel by way of a ceramic-containing adjustment part, wherein the adjustment part is tubular and consists of individual layers with different compositions, at least two materials A and B forming a plurality of layers of the adjustment part, these materials being chosen such that their coefficient of thermal expansion is between that of the feed-through and that of the end of the discharge vessel or at most is just outside, the layer thickness of each layer being so low that no shearing forces can occur, and the layer thickness of each layer of the same material being different.

In various embodiments, the adjustment part is radially layered.

In various embodiments, the adjustment part is axially layered.

In various embodiments, apart from the first and last layers, the individual layers of the adjustment part are each 1 to 200 μm thick, e.g. 5 to 150 μm.

In various embodiments, the layer thickness of a pair of layers respectively, of which one is made of material A and the other of material B, is substantially equal.

In various embodiments, the layer thickness of the respectively similar layers increases or decreases monotonously, the layer thicknesses of the material A and that of the material B developing in opposite directions from a maximum to a minimum.

In various embodiments, the feed-through comprises or predominatly contains Mo or W, the corresponding material of the adjustment layer comprising Mo powder or W powder in a content of at least 85% by volume.

In various embodiments, the discharge vessel comprises or consists of oxidic ceramic, the corresponding material of the adjustment layer comprising powder of the oxidic ceramic with a content of at least 85% by volume.

In various embodiments, the adjustment layer contains a further material C, so the layer sequence is ABC.

In various embodiments, the layers are designed as archimedian spirals, the layer thickness being based on a cross-section in the radial direction viewed from the center.

Various embodiments provide a method for producing a tubular adjustment part as described above, the method including:

In various embodiments, in b) a further material C is added which is either inserted as a foil between layers AB or is applied to one of the layers A or B.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high pressure discharge lamp, comprising:

a ceramic discharge vessel and a longitudinal axis, wherein at least one electrode is led out of the discharge vessel by means of a metal-containing feed-through, wherein the feed-through is connected to one end of the discharge vessel by way of a ceramic-containing adjustment part, wherein the adjustment part is tubular and, apart from a first and last layers, consists of individual layers with different compositions, at least two materials A and B respectively forming a plurality of layers of the adjustment part, these materials being chosen such that their coefficient of thermal expansion is between that of the feed-through and that of the end of the discharge vessel or at most is 10% outside, the layer thickness of each layer having reduced shear forces acting upon the layered material, and the layer thickness of the same material being different, wherein the layer thickness of each layer of the same material increases or decreases monotonously, the layer thicknesses of the material A and that of the material B developing in opposite directions from a maximum to a minimum thickness.

2. The high pressure discharge lamp as claimed in claim 1, wherein the adjustment part is radially layered.

3. The high pressure discharge lamp as claimed in claim 1, wherein the adjustment part is axially layered.

4. The high pressure discharge lamp as claimed in claim 1, wherein, apart from the first and last layers, the individual layers of the adjustment part are each 1 to 200 μM thick.

5. The high pressure discharge lamp as claimed in claim 1, wherein the layer thickness of a pair of layers respectively, of which one is made of material A and the other of material B, is substantially equal.

6. The high pressure discharge lamp as claimed in claim 1, wherein the feed-through comprises or predominantly contains Mo or W, the corresponding material of the adjustment layer comprising Mo powder or W powder in a content of at least 85% by volume.

7. The high pressure discharge lamp as claimed in claim 1, wherein the discharge vessel consists of oxidic ceramic, the corresponding material of the adjustment layer comprising powder of the oxidic ceramic with a content of at least 85% by volume.

8. The high pressure discharge lamp as claimed in claim 1, wherein the adjustment layer contains a further material C, so the layer sequence is ABC.

9. A method for producing a tubular adjustment part, the tubular adjustment part for a high pressure discharge lamp comprising:

individual layers with different compositions, at least two materials A and B forming a plurality of layers of the adjustment part, these materials being chosen such that their coefficient of thermal expansion is between that of a feed-through and that of the end of a discharge vessel of the lamp or at most is just outside, the layer thickness of each layer having reduced shear forces acting upon the layered material, and the layer thickness of each layer of the same material being different, the method comprising:

a) producing two types of foil A and B with varying layer thickness of at most 200 μm, formed respectively from a cermet of the components Mo or W and $Al_2O_3$, b) stacking and laminating a bundle of at least 30 foils, with one foil of type A and one foil of type B alternately being used, the layer thickness of each type of foil developing in opposite directions from a maximum to a minimum, and c) punching out tubular parts from the laminate which along their longitudinal axis or transverse axis therefore have an alternately different Me-content of at least one of the Mo or W.

10. The method as claimed in claim 9, wherein in b) a further material C is added which is either inserted as a foil between layers AB or is applied to one of the layers A or B.

11. The high pressure discharge lamp as claimed in claim 4, wherein the individual layers of the adjustment part are each 5 to 150 μm thick.

* * * * *